United States Patent [19]

King et al.

[11] Patent Number: 4,736,854

[45] Date of Patent: Apr. 12, 1988

[54] GARMENT RECEPTACLE CLOTHES HANGER SUPPORT

[75] Inventors: William L. King, Denver; Gregory W. O'Connor, Littleton, both of Colo.

[73] Assignee: Samsonite Corporation, Denver, Colo.

[21] Appl. No.: 79,608

[22] Filed: Jul. 30, 1987

[51] Int. Cl.[4] ..... A47F 7/24

[52] U.S. Cl. ..... 211/89; 206/286; 211/124

[58] Field of Search ..... 211/124, 7, 89, 94; 206/286

[56] References Cited

U.S. PATENT DOCUMENTS

| | | | |
|---|---|---|---|
| 1,687,129 | 10/1928 | Henninger | 211/124 X |
| 2,072,685 | 3/1937 | Richter . | |
| 2,348,271 | 5/1944 | Vonschott | 211/89 |
| 2,352,102 | 6/1944 | Johnston . | |
| 2,689,631 | 9/1954 | Marks . | |
| 2,860,788 | 11/1958 | Hardman | 211/89 |
| 2,893,545 | 7/1959 | Garfunkel . | |
| 3,221,848 | 12/1965 | O'Neil . | |
| 3,249,233 | 5/1966 | Marcus et al. | 211/105.3 |
| 3,322,288 | 5/1967 | Mayer | 211/193 |
| 3,527,352 | 9/1970 | De Lapa | 211/105.3 X |
| 3,542,170 | 11/1970 | Bialo | 223/88 X |
| 3,735,875 | 5/1973 | Parillo | 211/7 |
| 3,876,076 | 4/1975 | Hazelhurst | 211/89 X |
| 3,880,290 | 4/1975 | Hughes | 211/124 X |
| 3,981,404 | 9/1976 | Goeke | 211/105.3 X |
| 4,155,465 | 5/1979 | Baublitz | 211/105.3 X |
| 4,266,705 | 5/1981 | Wheeler | 211/124 X |
| 4,316,547 | 2/1982 | Varon | 211/124 X |

*Primary Examiner*—Robert W. Gibson, Jr.
*Attorney, Agent, or Firm*—Gregory W. O'Connor

[57] ABSTRACT

A hanger support trolley assembly which allows conventional clothes hangers to be loaded onto a support even though corner pockets in the garment bag are closely spaced on either side of the assembly. In one embodiment the hangers are supported on a sleeve slidably mounted on a support rod. When the sleeve is extended, hangers can be placed on the sleeve, and when closed a flange on the outer end of the sleeve retains the hangers in place. In another embodiment, the hangers are supported directly on a support rod, and the space surrounding the free end of the rod is guarded by one or more biased jaws of a spring clip. In both embodiments a concave overhead surface closely spaced from the arcuate rod prevents the hangers from being permanently transversely dislodged from the support.

20 Claims, 4 Drawing Sheets

GARMENT RECEPTACLE CLOTHES HANGER SUPPORT

FIELD OF THE INVENTION

This invention relates to means for supporting the hooked end portion of a clothes hanger in a garment receptacle. More particularly, it relates to a support structure adapted to receive a conventional clothes hanger within a relatively narrow limited space, and to restrain the hanger against subsequent dislodgement during use of the garment receptacle.

BACKGROUND OF THE INVENTION

Many different types of clothes hanger supports have been used in garment receptacles over the years. Often, in the case of garment bags, special hangers having a short hooked end are used to fit over generally U-shaped support member depending a short distance from the top panel of the bag. The short hooked end allows the hanger to be inserted transversely through the small space between the support bar of the U-shaped support member and the top panel of the bag. Such hangers usually have pivoted hooked portions, which allows normal-sized hooks to be provided on the end opposite the short-hooked end, so that the same hangers can be used to hang garments on a conventional clothes closet support rod.

This type of arrangement can be used when there is sufficient room for the hanger to be manipulated so that the end portion can be transversely fitted over the support bar. In one type of garment bag configuration, however, corner pockets provided in the upper portion of the interior of the bag are so closely spaced that there is little room to maneuver the clothes hanger, making it very difficult or impossible to transversely place the hooked end portion of a hanger over the usual type of hanger support bar. Complicating the problem further is the fact that when the corner pockets are deep, extending vertically downward a considerable distance, the hanger support structure has to be correspondingly lowered to allow the hanger arms to fit under the pockets. When this is done, the top panel of the garment bag is no longer close enough to the hanger support to act as a barrier to upward movement of the hanger during use of the bag, requiring some other retaining means to be provided to prevent such unwanted movement.

One way of overcoming this space limitation problem is to provide a support which does not require the hanger to be inserted in the usual transverse manner. Although not designed with this problem in mind, hanger supports have been developed in the past which permit clothes hangers to be inserted from the front of the garment bag over an outwardly extending hanger support member. One such arrangement is disclosed in U.S. Pat. No. 3,883,003, issued on May 13, 1975 to Samhammer et al, wherein a generally U-shaped clip is mounted from the top panel of a garment bag with the open end of the clip facing the front of the bag. An eccentrically mounted rotatable disc allows access to the hanger support area when rotated to its open position and closes the open end of the clip when rotated to its closed position. A latch is provided to hold the disc in its closed position, and upstanding retention ears are provided on the clip in the hanger support area to prevent hangers from falling out after they have been set in place but before the disc has been closed.

Although a hanger can be inserted directly toward the back of the garment bag with the Samhammer et al arrangement, this design has its drawbacks. There is no provision for use with deep corner pockets, where the hanger support would have to be spaced a considerable distance from the top panel of the garment bag. The need for the retention ears limits the usable hanger support space, and the type of disc latch employed requires the user to make sure, as a separate step in the loading of the garment bag, that the latch is positively closed after inserting the hangers. In addition, the flat clip configuration is not well suited for supporting the curved hooked portions of the ordinary type of clothes hanger.

Another hanger support design which permits hangers to be inserted from the front of the garment bag is disclosed in U.S. Pat. No. 4,618,058, issued on Oct. 21, 1986 to Gregg et al. In this arrangement an upper jaw is pivotally mounted to be moved into contact with a stationary lower jaw in order to clamp a hanger hook therebetween. A lever pivotally mounted on the upper jaw support structure contains a cam surface which acts to lower the upper jaw when the lever is pushed down. When the lever is fully depressed it is in its closed position, acting as a barrier to the hanger support area. The cam arrangement holds the lever in its closed position.

Although the hanger support surface of Gregg et al is shown spaced from the top panel of the garment bag, it has other drawbacks. The lever arrangement for holding the jaws in locked condition requires the user to positively push the lever until the cam has reached a point where it can act to hold the lever in place. If this is not done, or if the lever is bumped during use of the bag, the barrier to the hanger support area can open and the hangers will not be held in place. The support surface is not designed to accommodate the curved hooked portion of a clothes hanger, and in addition the use of levers and a cam surface makes the hanger support structure more complicated than desired, and consequently more costly to produce.

It would be desirable to have a hanger support structure which does not require the hangers ends to be transversely set in place within the confines of the interior space of the garment bag, and which does not suffer from the drawbacks of prior art hanger supports. Preferably, the hanger support should lock the hangers in place in a more automatic manner than is done in the prior art. In addition, it would also be desirable to have a hanger support surface which is able to conform more closely to the contour of the hanger hook, which would hold the hanger in place more securely and also prevent distortion of the hook. It would further be desirable to provide an improved hanger support structure which is relatively inexpensive to produce.

BRIEF SUMMARY OF THE INVENTION

These goals have been achieved by the present invention which provides a hanger support trolley assembly extending transversely of the front and back panels of a garment receptacle, and hanger retaining means adjacent to and operatively associated with the front end portion of the trolley assembly. The hanger retaining means is movable from a closed position, where it prevents the hooked portion of a clothes hanger from sliding off the front end portion of the support, to an open position, where it permits the hooked portion to be positioned on the hanger support means or removed therefrom. If desired, positive locking features which lock the hanger retaining means in place until released by the user may be incorporated to further ensure against accidental release of the hangers. In addition, a hanger retaining surface prevents the hooked portion of a clothes hanger from permanently transversely disengaging from the support means.

The specific features and other aspects of the invention, as will as its various benefits, will be made clear in the detailed description which follows.

DESCRIPTION OF THE INVENTION

Figure 1:
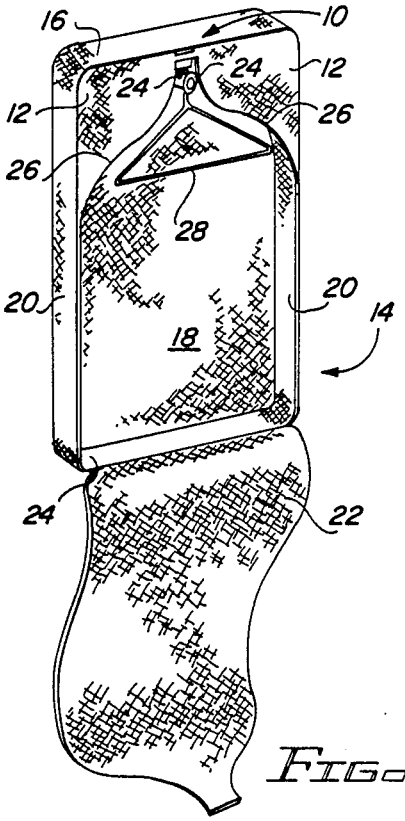
FIG. 1 is a pictorial representation of an open garment bag containing the hanger support structure of the present invention situated between corner pockets.

Referring to FIG. 1, the hanger support trolley assembly 10 of the present invention is located between two corner pockets 12 in flexible garment bag 14. The corner pockets 12, provided for the purpose of receiving items of clothing or accessories, are located between the top panel 16 and the upper portions of back panel 18 and side panels 20. An access panel 22 is shown in open position, hanging down from its flexible connection with the bottom panel 24, to permit garments to be introduced into the garment bag. Although the shape of the access panel indicates that its upper edges are intended to be attached to the bottom edges of the corner pockets when the access panel is closed, for purposes of this invention the panel could just as well be generally rectangular in shape, with its upper edges intended to be attached to the upper edges of the corner pockets.

As illustrated, the vertical portions 24 of the corner pockets are deep and relatively closely spaced, and the lower diagonal portions 26 of the pockets are designed to be substantially parallel to and adjacent the arms of hanger 28. This arrangement allows the corner pockets to be quite large. The deep vertical portions 24 permit ordinary clothes hangers having long neck portions to be used, and the lower diagonal portions 26 assist in holding the garments on the hangers in place.

Figure 2:
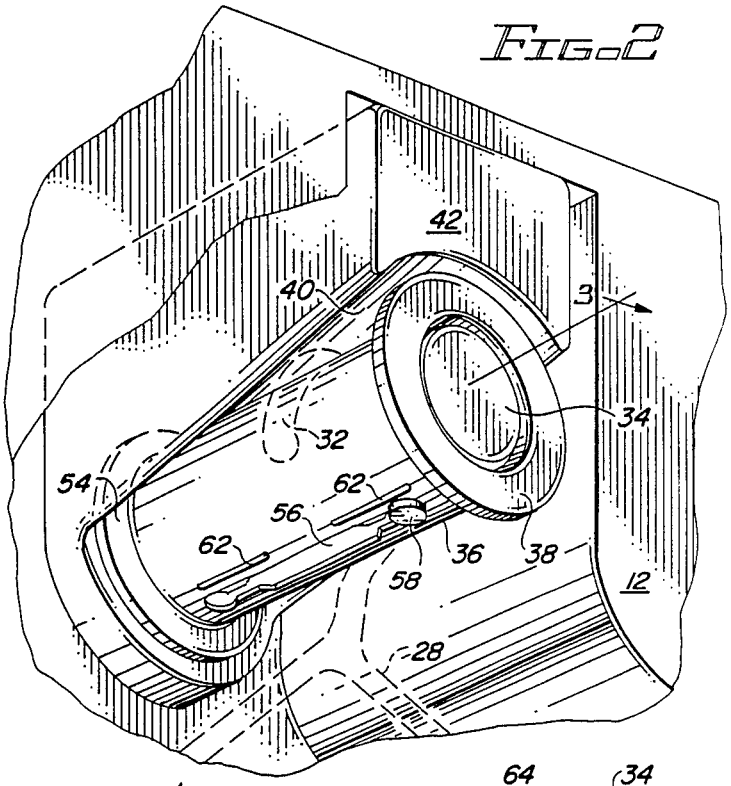
FIG. 2 is a partial pictorial representation of the upper interior portion of the garment bag of FIG. 1, showing one embodiment of the hanger support of the present invention.

Referring to FIG. 2, the hanger support assembly 10 of the present invention comprises a support rod 34 and a sleeve 36 slidably mounted thereon. The hooked portion 32 of the hanger 28 is shown supported on the sleeve 36. It is prevented from sliding off the sleeve by the annular flange 38 on the end of the sleeve, and is prevented from moving off the sleeve in an upward transverse direction by the curved surface 40 spaced a short distance from the sleeve. The curved surface 40 is the lower surface of housing 42 which overlies the sleeve 36.

Figure 3A:
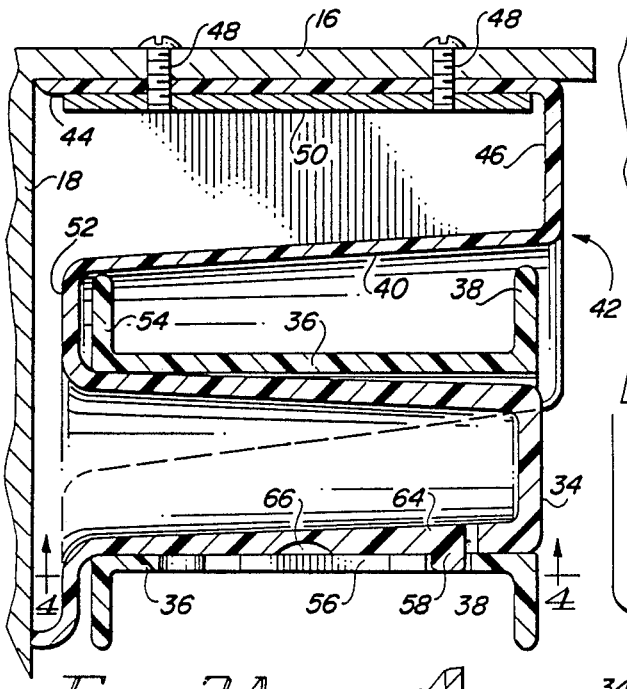
FIG. 3A is a longitudinal sectional view of the hanger support of FIG. 2, showing the hanger retaining sleeve in closed position.

As shown more clearly in FIG. 3A, the housing 42 is connected to an upper flat portion 44 by a front wall portion 46, the upper flat portion being attached to the top panel 16 of the garment bag by screws 48. To increase the holding power of the screws, a metal plate 50 is provided below the flat portion 44, an arrangement which is preferred where, as here, the flat portion is formed of plastic.

Connected to the housing 42 by a back wall section 52 is support rod 34. As can be seen, the entire structure that makes up the support rod, the overlying retaining surface and the flat attachment portion comprises an integral unit, preferably formed of plastic in a molding operation. The unit is preferably hollow, thereby reducing the weight and the cost of the item. As can be seen, the unit extends to the back panel 18 of the garment bag.

Figure 3B:
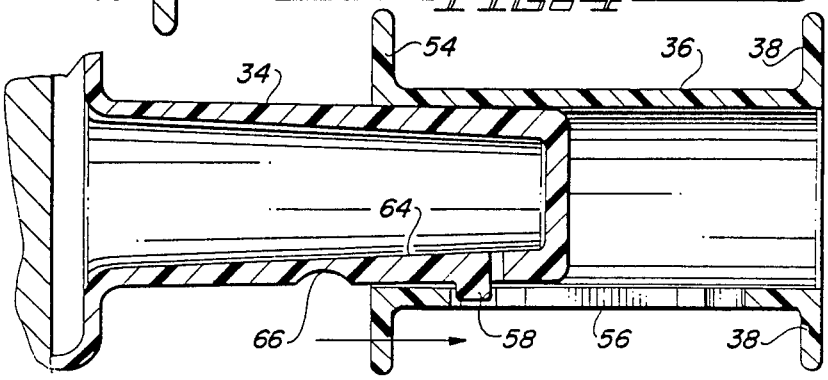
FIG. 3B is a view similar to that of FIG. 3A, but showing the hanger retaining sleeve in open position.

Referring to FIGS. 3A and 3B, the sleeve 36 is mounted for slidable movement on support rod 34 between the open position shown in FIG. 3B and the closed position shown in FIG. 3A. When the sleeve is in the open position, the hooked portion of a conventional clothes hanger can readily be placed on the sleeve as one would place a hanger on the support rod in a clothes closet. When all the hangers have been set in place, the user simply slides the sleeve back to its closed position where the flange 38 prevents the hangers from axially sliding off the sleeve, and the surface 40 prevents the hangers from moving upward enough to dislodge the hangers from the sleeve. The cantilevered construction of the support rod, whereby it is connected only at its back portion, allows the sleeve to slide freely over the support rod. Although the flange 54 on the back end of the sleeve is not needed to prevent the escape of hangers supported on the sleeve 36, it is preferred that it be incorporated on the sleeve in order to push the hanger hooks forward when sliding the sleeve forward. If the flange 54 were not present the hanger hooks could move off the back edge of the sleeve and would not be pulled out with the sleeve when unpacking the garment bag.

As shown in FIGS. 2, 3A, 3B and 4, the underside of the sleeve is provided with a groove 56 and the underside of the support rod is provided with a tab or detent 58 which rides in the groove. The ends of the groove contacting the detent 58 thus act to stop the axial movement of the sleeve on the support rod. Referring to FIG. 2, and in particular to FIG. 4, the groove has a narrow neck portion 60 adjacent each end of the groove. The neck portion is narrower than the width of the tab or detent 58, which would ordinarily prevent the sleeve from being moved beyond the point of contact between the tab and the neck portion. In this arrangement, however, slits 62, located on either side of the neck portions, allow the plastic material between the neck portions and the slits to yield toward the slits to permit the tab to move to the end of the groove 56. The sleeve is not able to slide on its own past the tab or detent because the required yielding of the material adjacent the neck portions can be accomplished only by the user pushing against or pulling the sleeve. Thus when in the open position of FIG. 3B, the sleeve will stay in that position while the hangers are being loaded or unloaded. Similarly, when in the closed position of FIG. 3A, the sleeve will stay in that position during use of the garment bag.

Figure 4:
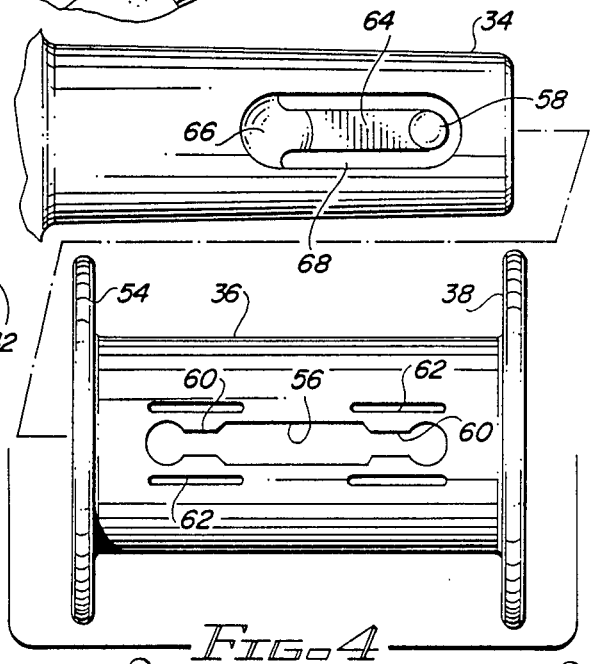
FIG. 4 is a bottom view of the hanger retaining sleeve and the support rod over which the sleeve slides.

In order to initially place the sleeve on the support rod it is necessary to move the detent 58 up into the support rod so that the outer tip of the detent is flush with the lower surface of the rod. The spring-like connection between the detent and the support rod makes this possible. As shown in FIGS. 3A, 3B and 4, the detent 58 depends from an arm 64 integrally formed with the support rod but connected thereto at an area of reduced thickness 66. As best shown in FIG. 4, the arm 64 is relatively narrow due to slot 68 partially surrounding it. This arrangement allows the arm to be pushed up into the rod against the bias of the connection 66 when the sleeve is placed on the rod. When the arm is released, it returns back to its normal position of FIGS. 3A and 3B, permitting the detent 58 to perform its stop function.

Although the groove and detent arrangement has been described with the groove in the sleeve and the detent on the support rod, it should be understood that the arrangement could be reversed if desired so that the groove is in the support rod and the detent is on the sleeve.

The embodiment of FIGS. 2–4 has a number of advantages. It permits side access to the hanger support by employing an extensible support sleeve. This unique arrangement allows garments to be hung on the extended support sleeve in loosely packed fashion prior to moving the support sleeve to its closed position and closing the access panel of the garment bag. Since garments are not wrinkled by hanging them in this manner, the bulk of the packing can be be done well before departure time. This arrangement also allows a garment on a back hanger to be removed from the garment bag without having to first remove all the other hangers. Further, when the sleeve is pushed into place to enable the access panel of the garment bag to be closed, the sleeve is automatically locked in its closed position. Conversely, when the sleeve is pulled out for use, the lock is automatically released. In addition, the large radius of the arcuate support sleeve spreads the load of the garments across a relatively large surface, preventing distortion of the hanger hooks.

Figure 5:
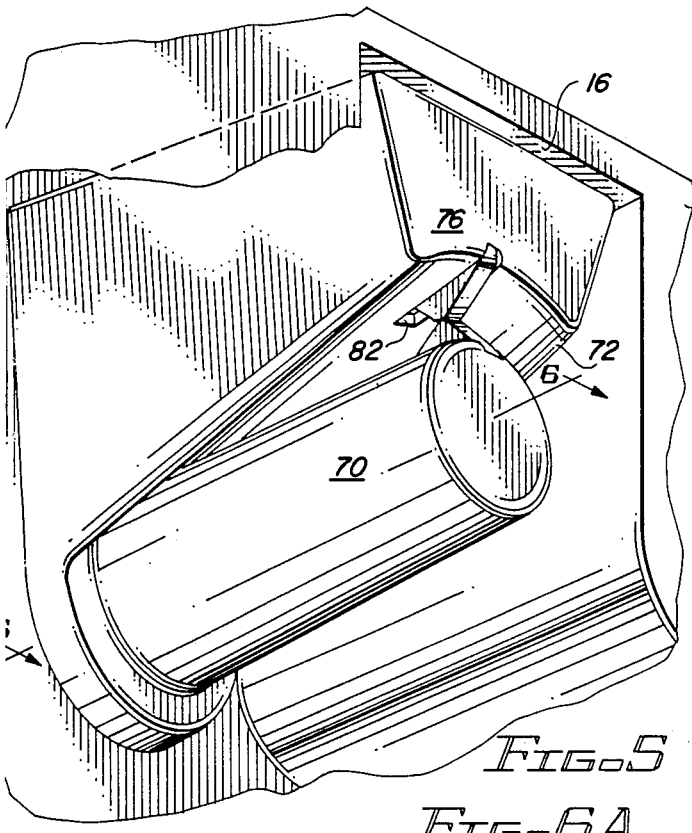
FIG. 5 is a view similar to that of FIG. 2, but showing another embodiment of the hanger support of the present invention.
Figure 7:
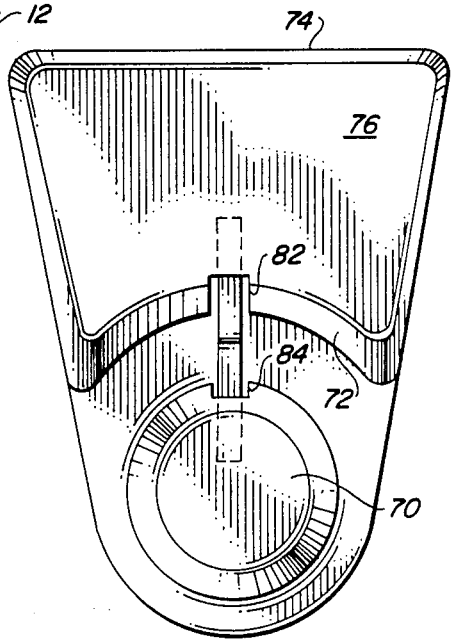
FIG. 7 is a front view of the hanger support of FIG. 5.
Figure 6A:
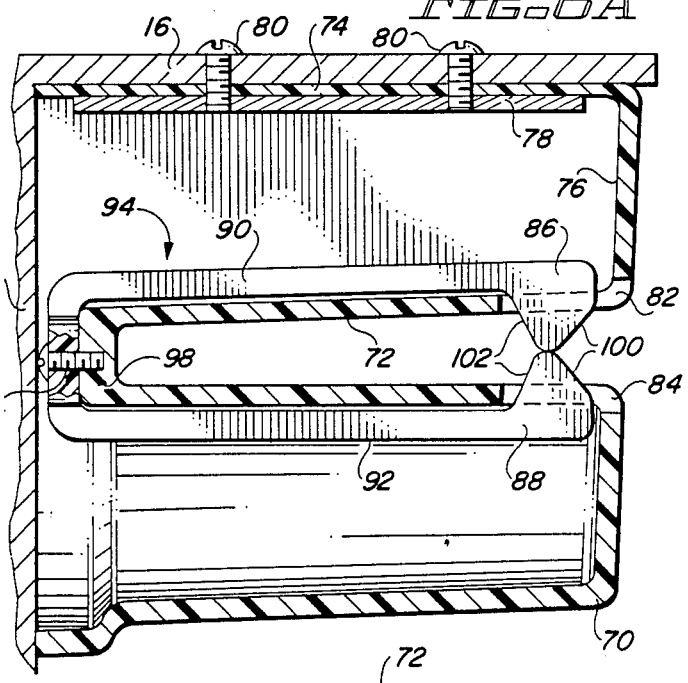
FIG. 6A is a longitudinal sectional view of the hanger support of FIG. 5, showing the hanger retaining clip in closed position.

A modified hanger support arrangement is shown in FIGS. 5–7. Referring at this time to FIGS. 5, 6A and 7, an integral plastic trolley support structure comprises a cantilevered hollow support rod 70, an overlying hanger retaining surface 72, and an upepr flat portion 74. The surface 72 is connected to the upper portion 74 by a front wall portion 76, and the upper portion 74 is connected to the top panel 16 of the garment bag by a metal plate 78 and screws 80. It will be appreciated that this arrangement is quite similar to the corresponding structure described in connection with the first embodiment of the invention, except that the support rod 70 is designed to directly receive the hooked end portions of clothes hangers instead of having a sleeve for this purpose. For this reason the distance between the support rod 70 and the retainer surface 72 need not be as great as it is in the first embodiment. It will also be appreciated that the relatively large radius of the arcuate support rod 70 distributes the hanger load in the same manner as the arcuate sleeve of the first embodiment.

Still referring to FIGS. 5, 6A and 7, the support surface 72 is provided with a short slot 82 adjacent the front wall portion 76, and the upper face of the support rod 70 is provided with an opposing short slot 84 adjacent the front wall of the rod. Extending through the slots are opposed upper and lower jaws 86 and 88 located at the ends of the upper and lower arms 90 and 92 of spring clip 94. The back wall of the spring clip 94 is attached by screw 96 to the wall 98 which connects the support rod 70 to the retaining surface 72. In its normal condition, illustrated in FIG. 6A, the jaws of the spring clip are biased shut.

Figure 6B:
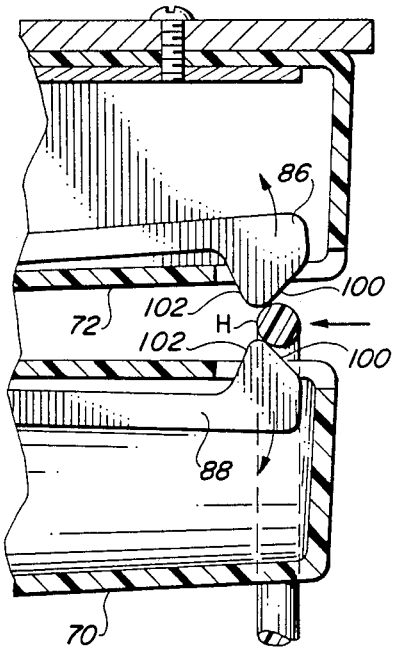
FIG. 6B is a partial sectional view of the end portion of the hanger retaining clip of FIG. 6A, showing the clip as it is being opened by a hanger being moved into place.
Figure 6C:
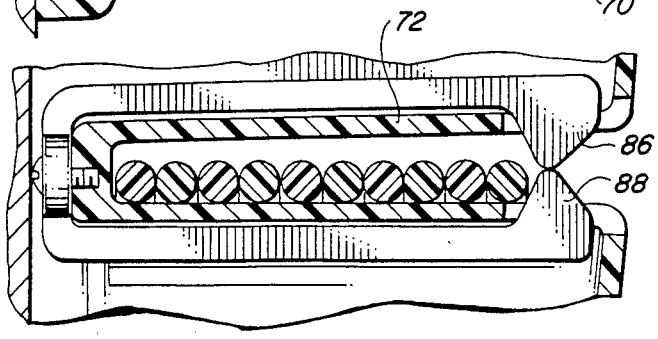
FIG. 6C is a longitudinal sectional view of the hanger retaining clip similar to that of FIG. 6A, showing the clip in closed position after hangers have been placed thereon.

Referring to FIG. 6B, a hanger H is placed on the support rod by sliding the hooked end portion over the free end of the support rod 70. To do this, the hanger has to be pushed with sufficient force to pry the jaws open against the bias of the spring clip arms. After this has been done, the jaws immeditely close again to lock the hangers on the support rod. The jaws thus function as a gate, opening to admit passage of a hanger and closing to retain it. As seen in FIG. 6C, the hangers H are prevented from sliding off the support rod by the jaws 86 and 88, and are prevented from being permanently vertically dislodged by the retainer surface 72.

To facilitate the introduction of hangers to the support rod, and to make it more difficult for the hangers to accidently escape from the support rod, the leading faces 100 of the jaws are angled to a lesser degree with respect to a plane taken through the contact points of the jaws than are the trailing faces 102. This design brings about the desired result because a greater component of vertical force is produced by movement of a hanger hook against the jaw faces 100, tending to open them more readily, than is prdouced by movement against the more steeply inclined faces 102.

In the description of the invention thus far, the mechanism for locking the hanger retaining means in place or for unlocking it to allow hangers to be removed or inserted is basically automatic in operation. That is, in the first embodiment the hanger retaining sleeve is fixed in its opened and closed positions simply by pulling the sleeve out to its extended position or pushing it in to its retracted position. The detent that holds the sleeve in place in either of these extreme positions is automatically engaged or disengaged by movement of the sleeve as it is pushed or pulled by the user. In the second embodiment the jaws of the hanger retaining spring clip are opened or closed by the user pushing or pulling the hangers through the jaws against their spring bias. In both embodiments, therefore, the normal steps one goes through to insert or remove the hangers are enough to engage or disengage the locking and retaining devices.

In some instances, such as when the garment load is unusually heavy, it may be desirable to make it even more difficult to overcome the locked hanger retaining devices so as to provide additional insurance against the accidental opening of the retaining devices. This can be accomplished by further modifying the previously described embodiments of the invention to require an additional step by the user before the locking or unlocking devices become operative, in accordance with the principles embodied in the following illustrative description.

Figure 8:
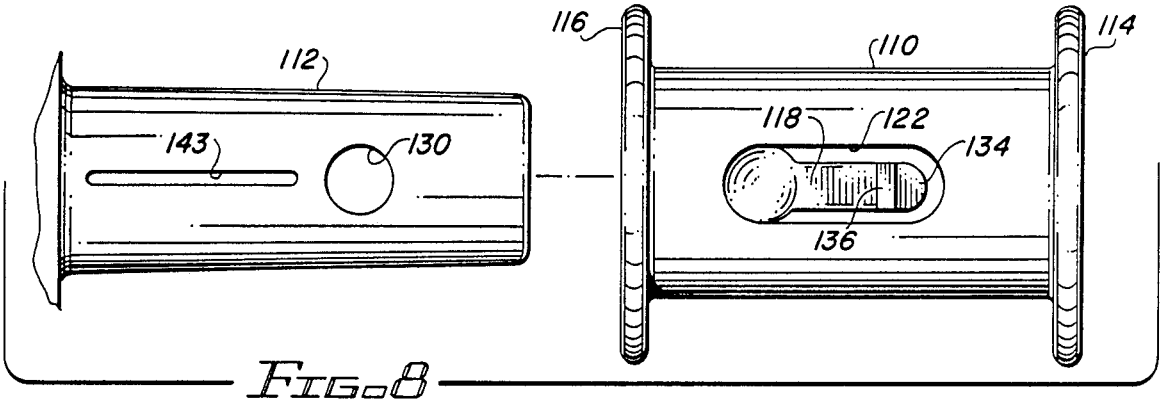
FIG. 8 is a bottom view of a hanger retaining sleeve and associated support rod similar to the view of FIG. 4, but showing a modified design.

Referring to FIG. 8, the embodiment of FIGS. 2–4 can be modified by using the sleeve 110 and support rod 112 instead of the sleeve and support rod of the FIG. 4 arrangement. The sleeve 110 has annular flanges 114 and 116 which serve the same purpose as the flanges 38 and 54 of the embodiment of FIGS. 2–4. In this embodiment, however, the sleeve 110 has an integral flexible arm 118 connected to the bottom wall of the sleeve at an area of reduced thickness 120, the arm being surrounded by a slot 122 and functioning in a manner similar to that of the arm 64 of the embodiment of FIGS. 2–4. A detent or tooth 124 on the end of the arm 118 extends inwardly of the sleeve and is biased in that direction by the connection between the sleeve and the flexible arm 118 for a purpose to be described shortly.

Figure 9A:
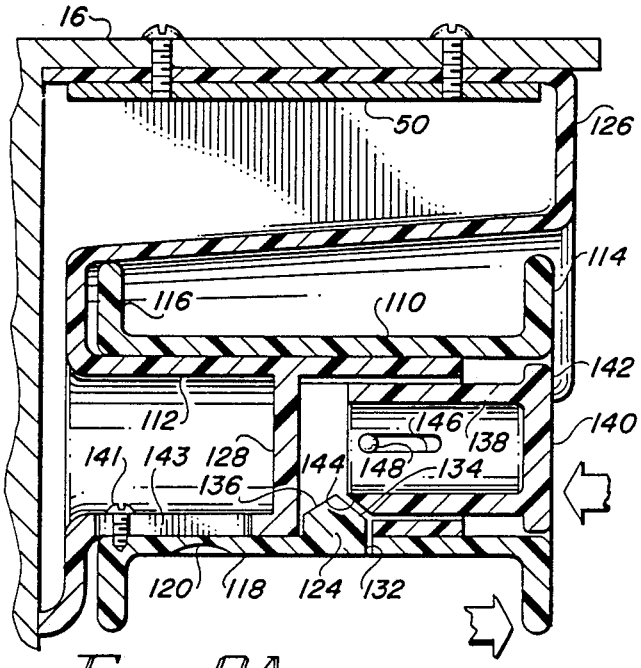
FIG. 9A is a longitudinal sectional view similar to that of FIG. 3A, but showing a modified hanger support arrangement incorporating the hanger retaining sleeve and support rod of FIG. 8, wherein the sleeve is shown in its closed or retracted position.
Figure 9B:
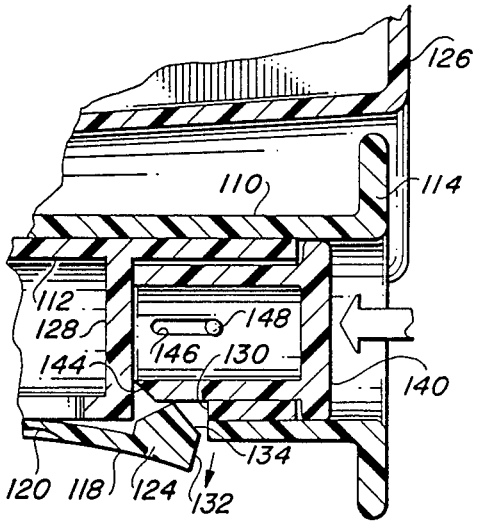
FIG. 9B is a partial longitudinal sectional view of the hanger retaining sleeve and support rod arrangement of FIG. 9A, showing the hanger retaining sleeve in unlocked condition.

As shown in FIG. 9A, the support rod 112 is part of an integrally formed housing 126 connected to the top panel 16 of a garment bag, the overall shape and construction of the housing being generally similar to that of the housing 42 of the embodiment of FIGS. 2–4. Instead of the hollow closed end shape of the support rod of FIGS. 2–4, however, the support rod 112 is open at its outer extremity and contains a wall 128 separating the back interior portion of the support rod from the outer interior portion. Just forward of the wall 128 in the bottom wall of the support rod 112 is an opening 130 into which the tooth or detent 124 extends in the normal locked position of the retracted sleeve 118. The detent has a vertically extending front facing wall portion 132 which engages the forward edge of the opening 130 to prevent forward movement of the hanger retaining sleeve 110. The detent also has a sloped forwardly facing wall portion 134 and a sloped backwardly facing wall portion 136.

Seated in the cavity of the outer interior portion of the support rod is a relatively short cylinder 138 which is closed off at its forward face by a wall or button 140 having an annular flange 142. The back end of the cylinder 138 has a sloped edge portion 144 which is shown in FIG. 9A as abutting the sloped wall 134 of the detent 124. The cylinder 138 is shown in its most forward position, with the annular flange 142 being spaced from the outer end of the support rod. The cylinder 138 is prevented from being pulled out any farther than shown by any suitable means, such as by the engagement of the back end of slot 146, formed in the side wall of the cylinder 138, with a pin 148 projecting from the adjacent side wall of the outer hollow portion of the support rod 112.

Referring to FIGS. 9A and B, in order to extend the support sleeve 110 the user must push in on the button 140. The natural way to do this is to push with the thumb while the forefinger is curled under the sleeve 110 behind the lower portion of the flange 114. This gives leverage to the thumb and causes the forefinger to pull outwardly against the sleeve flange 114. The initial result of this action is to push the sloped edge portion 144 back against the sloped wall 134 of the detent 124. The sloped portion 144 acts as a cam to push the detent down out of contact with the forward edge of the opening 130, thereby permitting the cylinder 138 to slide back to the wall 128 and the sleeve to move forward. As the sleeve moves forward, the sloped surface 134 of the detent or the high point of the detent between the sloped surfaces 134 and 136 may again contact the back edge of the opening 130, but in this event the sloped surfaces of the detent would simply slide by the edge of the opening.

Figure 9C:
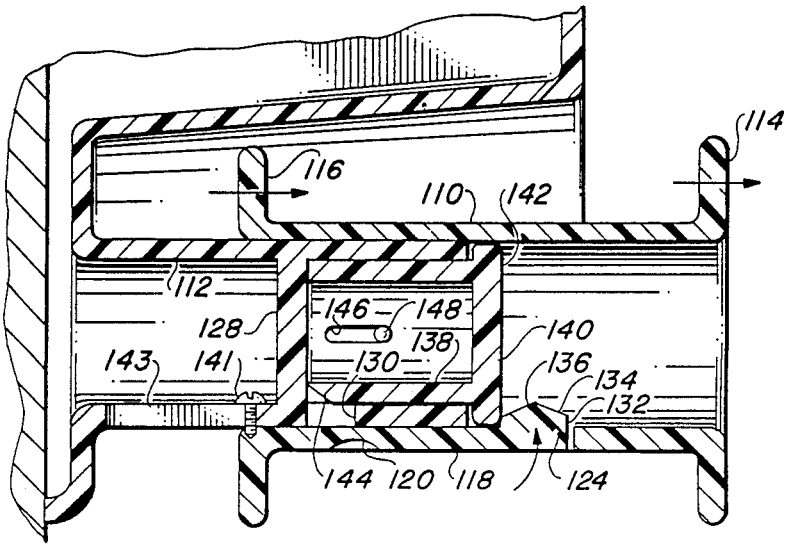
FIG. 9C is a partial longitudinal sectional view similar to that of FIG. 9B, but showing the hanger retaining sleeve in its open or extended position.

Continued pulling of the support sleeve brings it to the position shown in FIG. 9C, wherein the sleeve is in its fully extended position. Hangers can be freely removed or inserted onto the sleeve in this condition. To move the support sleeve back to its retracted position, it is merely necessary to push it back in that direction. In so doing, the sloped detent surface 136 will ride down the forward edge of the annular flange 142, thus moving out of the path of travel to permit movement of the sleeve toward its retracted position, at which point the detent will spring up into the opening 130 and again assume the position illustrated in FIG. 9A. Travel between the two extreme positions of the sleeve 110 shown in FIGS. 9A and 9C is controlled in part by the interengagement of self-tapping screw 141 affixed to the lower portion of flange 116 and slot 143 in support rod 112.

The detent or tooth 124 of this modification thus provides a positive locking surface which prevents the sleeve from being moved to its extended position without the user first pushing in the button 140 to inactivate the detent. It further prevents the sleeve from sliding back into its retracted position after it has been extended unless the user applies enough pressure to cause the detent arm 118 to flex back out of the way.

Figure 10A:
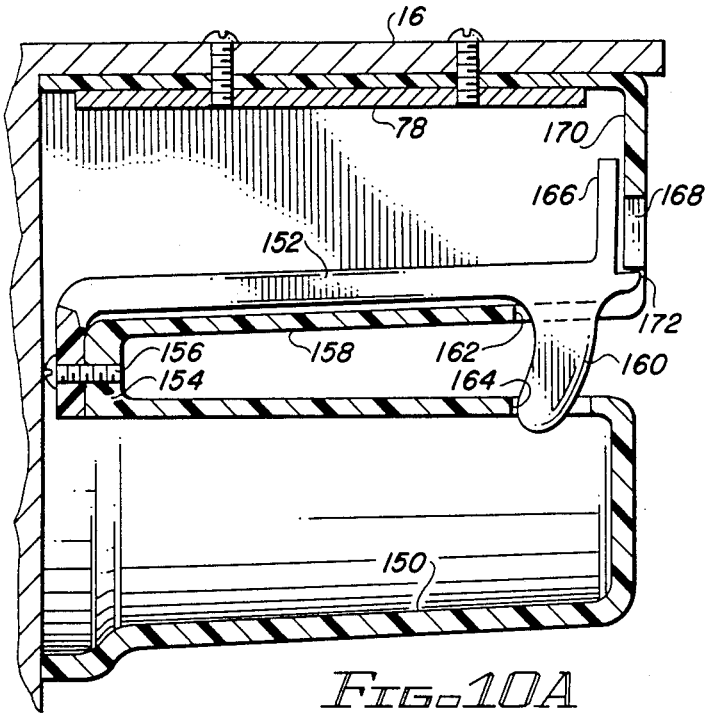
FIG. 10A is a longitudinal sectional view similar to that of FIG. 6A, but showing a modified positive locking arrangement in its closed or locking condition.
Figure 11A:
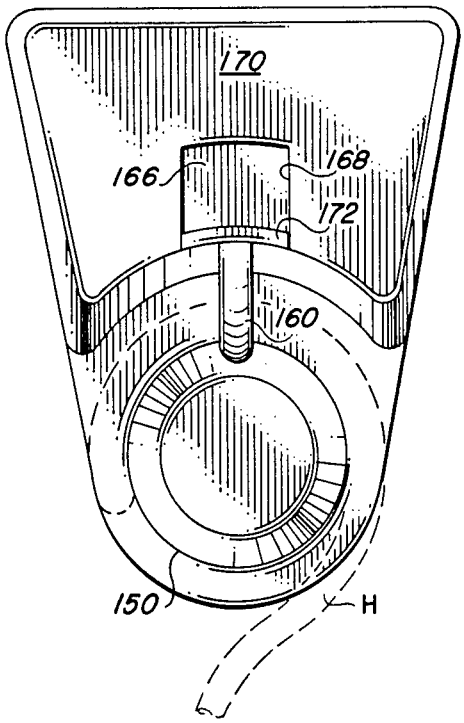
FIG. 11A is a front view of the hanger support arrangement of FIG. 10A.

Another embodiment of the invention, which represents a modification of the arrangement of FIGS. 5–7, is shown in FIGS. 10A and 11A. In this modification an integral housing generally similar to the housing of FIGS. 5–7 is provided, including a hollow support rod 150, similar to the support rod 70 of FIGS. 5–7. Instead of a spring clip having opposed jaws, as in the embodiment of FIGS. 5–7, this modification provides only a single arm 152 secured to the back wall 154 of the housing by a screw 156. As in the embodiment of FIGS. 5–7, the arm lies over the concave curved surface 158 of the housing and the end of the arm carries a jaw or tooth 160 extending through an opening 162 in the central portion of the concave surface 158. In this embodiment, however, the tooth 160 is relatively long, extending into an opening or recess 164 in the upper surface of the support rod 150. Thus in its normal locking position the tooth 160 is urged down into the recess 164 by the spring bias of the arm 152 so as to prevent hangers H on the support rod 150 from sliding off the rod.

Still referring to FIGS. 10A and 11A, the forward surface of the spring arm 152 adjacent the tooth 160 is integrally attached to a vertical plate or window 166 which is aligned with an opening 168 in the upper front wall 170 of the housing. The front face of the window 166 is slightly spaced from the back face of the housing wall 170 so as to permit relative sliding movement between the two faces. The lower edge of the window 166 extends forward to form a lip or ledge 172 which a user would use to raise the window.

Figure 10B:
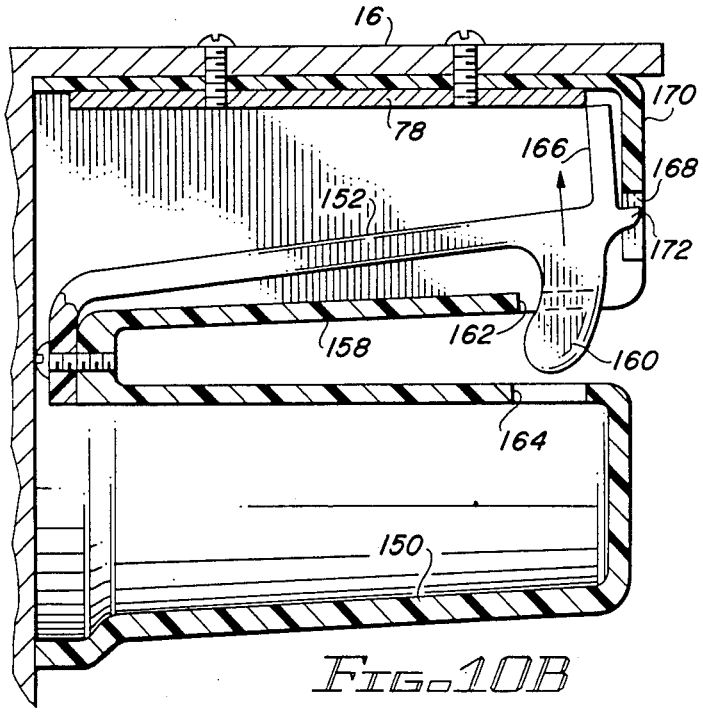
FIG. 10B is a partial longitudinal sectional view similar to that of FIG. 10A, but showing the positive locking arrangement in its open or unlocked condition.
Figure 11B:
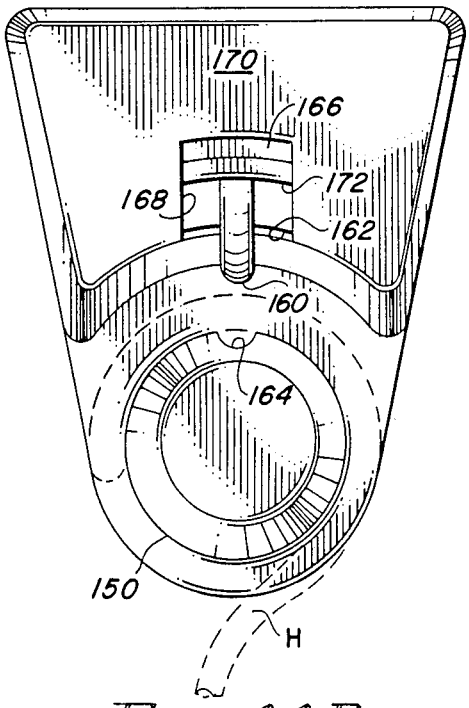
FIG. 11B is a front view of the hanger support arrangement of FIG. 10B.

As shown in FIGS. 10B and 11B, when a user lifts the window 166, the attached tooth 160 is raised therewith against the bias of the spring arm 152. The distance the window is moved is sufficient to raise the tooth 160 up out of the path of the hangers H so that the hangers can be removed. After the selected hangers are removed, the user simply removes his or her finger and the spring arm 152 returns the tooth 160 to its normal locked position, lowering the window 166 at the same time. Note that the back face of the tooth 160 is curved backward in order to prevent the tooth from being pushed open by hangers subjected to a forwardly directed force. If the back face were sloped in the other direction the hangers could possibly push the tooth open in the manner of a cam. In contrast, the forward face of the tooth 160 is sloped inwardly. Thus in order to place a hanger onto the support rod 150 the user need only push the hanger against the front face to cam the tooth out of the way. Once a hanger H moves past the tooth, the tooth will immediately snap down, preventing any hangers from inadvertently slipping past the tooth and off the support rod.

The spring arm and tooth of this embodiment thus function to prevent the escape of hangers unless the tooth is raised out of the way by the positive step of the user lifting the window to which the tooth is attached. Even though it is a simple step to follow, a printed reminder could be provided on the front face of the window if desired.

It should now be clear that the present invention provides a unique inexpensive hanger support arrangement that allows hangers to be inserted onto the support even in garment receptacle environments that offer little or no room on either side of the support, while still providing a retaining surface which prevents hangers from moving up off the support during use. The point of support can be located a substantial distance from the top panel if the presence of closely spaced deep corner pockets or other structure requires it. Further, this arrangement prevents the clothes hangers, which may be of the conventional type used in the home, from being jostled free during use of the garment bag.

It should be obvious that although two preferred embodiments of the invention and modifications thereof have been described, changes to certain specific details of the preferred embodiments and their modifications can be made without departing from the spirit and scope of the invention as defined in the accompanying claims.

What is claimed is:

1. A hanger support trolley assembly adapted for use in a garment receptacle of the type having a front panel, a back panel spaced therefrom, and a top panel to which the upper portion of the back panel is connected, the hanger support trolley assembly comprising:

hanger support means adapted to be located in the upper interior portion of a garment receptacle of the aforesaid type such that the hanger support means extends transversely of the front and back panels and has an unsupported front end portion;

a portion of the hanger support means being adapted to be engaged by the hooked portion of a clothes hanger, said hanger support portion being arcuate in transverse cross section;

a hanger retaining surface spaced upwardly from the hanger support means a distance sufficient to allow the hooked portion of a clothes hanger to be moved into place in the space between the hanger retaining surface and the hanger support means but close enough to the hanger support means to prevent the hooked portion of a clothes hanger from permanently disengaging from the hanger support means during use of the garment receptacle;

the hanger retaining surface having a concave portion generally uniformly spaced from the arcuate surface of the hanger support portion;

means attaching the hanger support means to the garment receptacle; and hanger retaining means adjacent to and operatively associated with the front end portion of the hanger support means;

the hanger retaining means being movable from a closed position, whereby it prevents the hooked portion of a clothes hanger from sliding off the front end portion of the hanger support means, to an open position, whereby it permits the hooked portion of a clothes hanger to be positioned on the hanger support means.

2. A hanger support trolley assembly according to claim 1, wherein the hanger support means comprises a support rod, means integrally connecting the back end portion of the support rod to the hanger retaining surface, and means connecting the hanger retaining surface to the hanger support attaching means so that the hanger retaining surface is spaced a substantial distance from the top panel of the garment receptacle.

3. A hanger support trolley assembly according to claim 1, wherein the type of garment receptacle in which the hanger support trolley assembly is adapted to be used further includes corner pockets extending downwardly from the top panel at the upper top corners of the garment bag, each corner pocket having a generally vertically extending surface relatively closely spaced from and facing the vertical surface of the other corner pocket, the hanger support means being adapted to be located between the two vertical corner pocket surfaces.

4. A hanger support trolley assembly according to claim 3, wherein the garment bag includes side panels, and wherein each corner pocket has a surface extending diagonally from the lower end of its vertical surface to the nearest side panel, the side and shape of the pockets being such that the arms of a clothes hanger supported by its hooked portion on the hanger support means are closely spaced to the diagonal surfaces of the corner pockets.

5. A hanger support trolley assembly according to claim 1, wherein the hanger support means comprises a support rod and a sleeve slidably mounted on the support rod from a closed position, wherein the front end of the sleeve is adjacent the unsupported front end of the support rod, to an open position, wherein the front end of the sleeve extends outwardly a substantial distance beyond the front end of the support rod, the hanger retaining means further comprising stop means on the front end of the sleeve whereby when the sleeve is in its open position the hooked portion of a hanger can be placed on the sleeve, and when the sleeve is in its closed position the stop means prevents the hooked portion from sliding off the front end of the sleeve.

6. A hanger support trolley assembly according to claim 5, including additionally means for locking the sleeve in place on the support rod when the sleeve is in its closed position and when the sleeve is in its open position.

7. A hanger support trolley assembly according to claim 1, wherein the hanger support means comprises a support rod, and wherein the hanger retaining means comprises gate means adjacent the front end of the support rod, the gate means being normally biased toward its closed position whereby the hooked portion of a clothes hanger supported on the rod is prevented from sliding off the outer end of the rod, and means for overcoming the biasing force to temporarily open the gate means to permit the hooked portion of a hanger to pass therethrough.

8. A hanger support trolley assembly according to claim 7, wherein the gate means comprises a spring clip having opposed jaws biased toward each other and wherein the means for overcoming the biasing force of the gate means comprises means facilitating opening of the jaws when the hooked portion of a clothes hanger is pushed against the jaws in a direction toward the back panel of the garment receptacle, and means making it more difficult for the hooked portion of a hanger to open the jaws when pushed in the opposite direction.

9. A hanger support trolley assembly for use in a garment receptacle having an upper portion and an access panel, the hanger support trolley assembly comprising:

a support rod in the upper portion of the garment bag extending outwardly in the direction of the access panel and terminating in a free unsupported end;

a sleeve slidably mounted on the support rod between an open position, wherein a portion of the sleeve extends beyond the free end of the support rod, and a closed position, the sleeve being adapted to support the hooked portion of a clothes hanger;

a hanger retaining surface spaced above the support rod a distance sufficient to prevent the hooked portion of a hanger from being permanently transversely dislodged from the sleeve when the sleeve is in closed position;

hanger retaining means adjacent the free end of the sleeve for preventing the hooked portion of a hanger from sliding off the end of the sleeve during use of the garment bag; and means cooperatively connecting the sleeve and the support rod to hold the sleeve in place on the rod when the sleeve is in both its open and closed positions.

10. A hanger support trolley assembly according to claim 9, wherein the means cooperatively connecting the sleeve and the support rod comprises a groove in either of the support rod or the sleeve and a detent on the other, the detent extending into the groove, and means for holding the detent at one end of the groove when the sleeve is in its open position, and for holding the detent at the other end of the groove when the sleeve is in its closed position.

11. A hanger support trolley assembly according to claim 10, wherein the groove has a narrow neck portion adjacent each end thereof, and means associated with the narrow neck portions permitting the detent, upon the application of force in a direction axially of the support rod, to be forced through the narrow neck portions of the groove.

12. A hanger support trolley assembly according to claim 9, wherein the means cooperatively connecting the sleeve and the support rod comprises a detent connected to the sleeve, the support rod having an opening for receiving the detent, means urging the detent into the opening in the support rod, whereby the sleeve is prevented from sliding along the support rod, and means operatively connected to the support rod for moving the detent out of the opening to permit the sleeve to slide along the support rod.

13. A hanger support trolley assembly according to claim 12, wherein the detent has a sloped surface facing the unsupported end of the support rod, wherein the free unsupported end portion of the support rod comprises a hollow portion, and wherein the means operatively connected to the support rod for moving the detent out of the opening comprises means slidably mounted in the hollow portion of the support rod, said latter means having an inner end and an outer end, the inner end including a sloped surface adapted to contact the sloped surface of the detent to push the detent out of the opening when the slidably mounted means is pushed toward the inner end thereof.

14. A hanger support trolley assembly according to claim 13, wherein the slidably mounted means is of a length such that when the sleeve has been moved outwardly to its open position, the detent extends forward of the outer end of the slidably mounted means, the detent containing a second sloped surface which upon the sleeve being pushed inwardly engages the outer end of the slidably mounted means and is forced against its bias to a nonlocking position.

15. A hanger support trolley assembly for use in a garment receptacle having an upper portion and an access panel, the hanger support trolley assembly comprising:

a support rod in the upper portion of the garment bag extending outwardly in the direction of the access panel and terminating in a free unsupported end, the support rod being adapted to support the hooked portion of a clothes hanger;

a hanger retaining surface spaced above the support rod a distance sufficient to prevent the hooked portion of a hanger from being permanently transversely dislodged from the support rod during use of the garment bag; and hanger retaining means adjacent the free end of the support rod for allowing the hooked portion of a hanger to be placed on the support rod but preventing the hooked portion from sliding off the end of the support rod during use of the garment bag;

the hanger retaining means comprising gate means normally biased toward the closed position whereby the gate means obstructs at least a portion of the space immediately surrounding the support rod adjacent the free end thereof, the means biasing the gate means including means allowing the gate means to be opened against the biasing force to permit the hooked portion of a hanger to be placed on the support rod.

16. A hanger support trolley assembly according to claim 15, wherein the hanger retaining surface contains a slot adjacent the free end of the support rod, the gate means extending through the slot into the space between the hanger retaining surface and the support rod.

17. A hanger support trolley assembly according to claim 15, wherein the support rod is hollow and the space on the other side of the hanger retaining surface is at least partially unobstructed, the support rod and the hanger retaining surface containing opposing slots adjacent the free end of the support rod, and wherein the gate means comprises a spring clip having a first leg extending through the hollow support rod and a second leg extending along the other side of the hanger retaining surface, at least one of the spring clip legs terminating in a jaw extending through its associated slot to obstruct passage of the hooked portion of a hanger.

18. A hanger support trolley assembly according to claim 17, wherein both spring clip legs terminate in a jaw extending through their associated slots, the jaws facing one another, and wherein the surfaces of the jaws leading to the entry end thereof are sloped with respect to the engaging jaw surfaces at an angle less than that of the surfaces of the jaws leading away from the entry end, whereby it requires less force to pry apart the jaws with the hooked portion of a hanger when moving the hanger in a direction into the hanger support area than it does when the hanger is moving in a direction away from the hanger support area.

19. A hanger support trolley assembly according to claim 16, wherein the gate means comprises a spring arm extending along the side of the hanger retaining surface opposite the side adjacent the hangers, the spring arm having a detent extending through the slot in the hanger retaining surface, the upper surface of the support rod having a recess for receiving the lower end of the detent to prevent hangers from sliding past the detent, and the spring arm including an extension attached thereto and extending in a direction away from the support rod, the extension being adapted to be lifted by a user so that the gate means is moved against the bias to an open position.

20. A hanger support trolley assembly according to claim 19, wherein the hanger retaining surface is connected to a front housing wall, the front housing wall having an opening therein aligned with the gate means extension, whereby a user can have access to and lift the extension to raise the detent away from its locked position.

* * * * *